US007124602B2

(12) United States Patent
Lee et al.

(10) Patent No.: US 7,124,602 B2
(45) Date of Patent: Oct. 24, 2006

(54) DIRECT COOLING TYPE REFRIGERATOR AND EVAPORATING PIPE FIXING METHOD IN THE REFRIGERATOR

(75) Inventors: Tae Hee Lee, Seoul (KR); Kyung Sik Kim, Incheon-si (KR); Yang Gyu Kim, Seoul (KR); Se Young Kim, Seoul (KR); Chan Ho Chun, Seoul (KR); Youn Seok Lee, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 72 days.

(21) Appl. No.: 10/745,590

(22) Filed: Dec. 29, 2003

(65) Prior Publication Data

US 2004/0144129 A1 Jul. 29, 2004

(30) Foreign Application Priority Data

Jan. 29, 2003 (KR) ..... 10-2003-0005890

(51) Int. Cl.
*F25D 23/06* (2006.01)

(52) U.S. Cl. ..... 62/451; 62/407

(58) Field of Classification Search ..... 62/406, 62/407, 440, 447, 451, 453
See application file for complete search history.

(56) References Cited

U.S. PATENT DOCUMENTS 4,204,620 A 5/1980 Wurfel
6,253,668 B1 * 7/2001 Lee ..... 99/468
6,619,070 B1 * 9/2003 Shin ..... 62/440

FOREIGN PATENT DOCUMENTS

| | | |
|---|---|---|
| CN | 1257816 | 6/2000 |
| KR | 2001-0055658 A | 7/2001 |
| KR | 20-0240657 Y1 | 10/2001 |

* cited by examiner

*Primary Examiner*—Melvin Jones
(74) *Attorney, Agent, or Firm*—Birch, Stewart, Kolasch & Birch, LLP

(57) ABSTRACT

A direct cooling type refrigerator capable of increasing the heat exchange performance of a refrigerant, thereby rapidly cooling its storage compartment. The refrigerator includes an outer casing defining an appearance of the refrigerator, an inner casing arranged within the outer casing, and defined with a storage compartment, an insulator interposed between the outer casing and the inner casing, a compressor for compressing a refrigerant, and an evaporator arranged to be in contact with the inner casing, and adapted to cool the inner casing in accordance with evaporation of a refrigerant passing therethrough.

22 Claims, 13 Drawing Sheets

DIRECT COOLING TYPE REFRIGERATOR AND EVAPORATING PIPE FIXING METHOD IN THE REFRIGERATOR

This nonprovisional application claims priority under 35 U.S.C. § 119(a) on Patent Application No. 10-2003-0005890 filed in Korea on Jan. 29, 2003, which is herein incorporated by reference.

BACKGROUND OF THE INVENTION

1. Field of the Invention

The present invention relates to a direct cooling type refrigerator, and more particularly to a direct cooling type refrigerator in which the contact area between an inner casing defined with a storage compartment and an evaporator is large so that the storage compartment can be rapidly cooled.

2. Description of the Related Art

Generally, refrigerators may be classified, in terms of their cooling systems, into a direct cooling type refrigerator, in which its inner casing defined with a storage compartment to be used as a freezing compartment or refrigerating compartment is directly cooled by an evaporator, and an indirect cooling type refrigerator, in which cold air produced in accordance with a heat exchange operation of the evaporator is supplied to the storage compartment by a cooling fan.

As shown in FIGS. 1 and 2, the direct cooling type refrigerator generally includes an outer casing 2 defining the appearance of the refrigerator, an inner casing 4 arranged within the outer casing 2, and defined with a storage compartment F, and an insulator 6 interposed between the outer casing 2 and the inner casing 4. The direct cooling type refrigerator also includes a compressor 8 for compressing a refrigerant, a condenser 10 for condensing a high-pressure refrigerant gas emerging from the compressor 8 into a liquid phase, a capillary tube 12 for reducing the pressure of the refrigerant emerging from the condenser 10, and an evaporator 14 for performing heat exchange with the inner casing 4, thereby cooling the storage compartment F.

The condenser 10 includes a heat transfer plate 10*a*, and a condensing pipe 10*b* attached to one surface of the heat transfer plate 10*a* such that it is linearly in contact with the heat transfer plate 10*a*.

The evaporator 14 is a hollow circular evaporating pipe attached to the outer side surfaces of the inner casing 4, and adapted to allow a refrigerant R to pass therethrough.

The evaporating pipe 14 is arranged along the outer surface of the inner casing 54. This evaporating pipe 14 has a plurality of connected pipe portions extending horizontally while being vertically spaced apart from one another. The evaporating pipe 14 is fixed by aluminum tapes 15 attached to the inner casing 54 such that it is linearly in contact with the inner casing.

In the above mentioned conventional direct cooling type refrigerator, the time taken to transfer the heat from the inner casing 4 to the refrigerant R passing through the evaporating pipe 14 is lengthened because the hollow circular evaporating pipe 14 is linearly in contact with the inner casing 4. Furthermore, the evaporating pipe 14 may not be in contact with the inner casing 4 at a certain portion thereof. In this case, there may be problems of an increased deviation in cooling performance. Moreover, the evaporating pipe 14 cannot be firmly fixed because it is fixed to the aluminum tape 15 which is, in turn, fixed to the inner casing 4. For this reason, the contact between the evaporating pipe 14 and the inner casing 4 may be degraded when an external impact is applied to the refrigerator.

FIG. 3 is a sectional view illustrating another example of a general evaporator used in a direct cooling type refrigerator. As shown in FIG. 3, the evaporator includes two heat transfer metal members 30 and 32 bonded to each other by an adhesive 40 coated between the heat transfer metal members 30 and 32 at regions other than a region where a refrigerant passage 36 is to be formed. When high-pressure air is injected between the heat transfer metal members 30 and 32 at the regions where the adhesive 40 is not coated, one of the heat transfer metal members 30 and 32, that is, the heat transfer metal member 32 in the illustrated case, is expanded at the regions where the adhesive 40 is not coated, thereby forming the refrigerant passage 36.

In such an evaporator, however, there may be a problem in that the expansion of the heat transfer metal member by high-pressure air may be non-uniform, so that pressure drop or blocking of a refrigerant flow may occur at a portion of the refrigerant passage 36.

SUMMARY OF THE INVENTION

The present invention has been made in view of the above mentioned problems involved with the related art, and an object of the invention is to provide a direct cooling type refrigerator capable of making a refrigerant used therein exhibit high heat exchange performance, thereby rapidly cooling its storage compartment, while exhibiting a minimum heat exchange performance deviation.

Another object of the invention is to provide an evaporating pipe fixing method in a direct cooling type refrigerator which is capable of firmly fixing an evaporating pipe to an inner casing of the refrigerator.

In accordance with one aspect, the present invention provides a direct cooling type refrigerator comprising: an outer casing defining an appearance of the refrigerator; an inner casing arranged within the outer casing, and defined with a storage compartment; an insulator interposed between the outer casing and the inner casing; a compressor for compressing a refrigerant; and an evaporator arranged to be in contact with the inner casing, and adapted to cool the inner casing in accordance with evaporation of a refrigerant passing therethrough.

In accordance with another aspect, the present invention provides an evaporating pipe fixing method in a refrigerator comprising the steps of: (A) forming, at an evaporating pipe, a surface contact area adapted to come into contact with an inner casing of the refrigerator; (B) applying an adhesive to the surface contact area of the evaporating pipe; and (C) bringing the evaporating pipe into close contact with the inner casing such that it is bonded to the inner casing at the surface contact area.

In accordance with another aspect, the present invention provides an evaporating pipe fixing method in a refrigerator comprising the steps of: (A) forming, at an evaporating pipe, a surface contact area adapted to come into contact with an inner casing of the refrigerator; (B) attaching a release tape coated with an adhesive to the surface contact area of the evaporating pipe; and (C) separating the release tape from the evaporating pipe such that the adhesive is exposed, and bringing the evaporating pipe into close contact with the inner casing such that it is bonded to the inner casing at the surface contact area.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, preferred embodiments of the present invention will be described in detail with reference to the annexed drawings.

Figure 1:
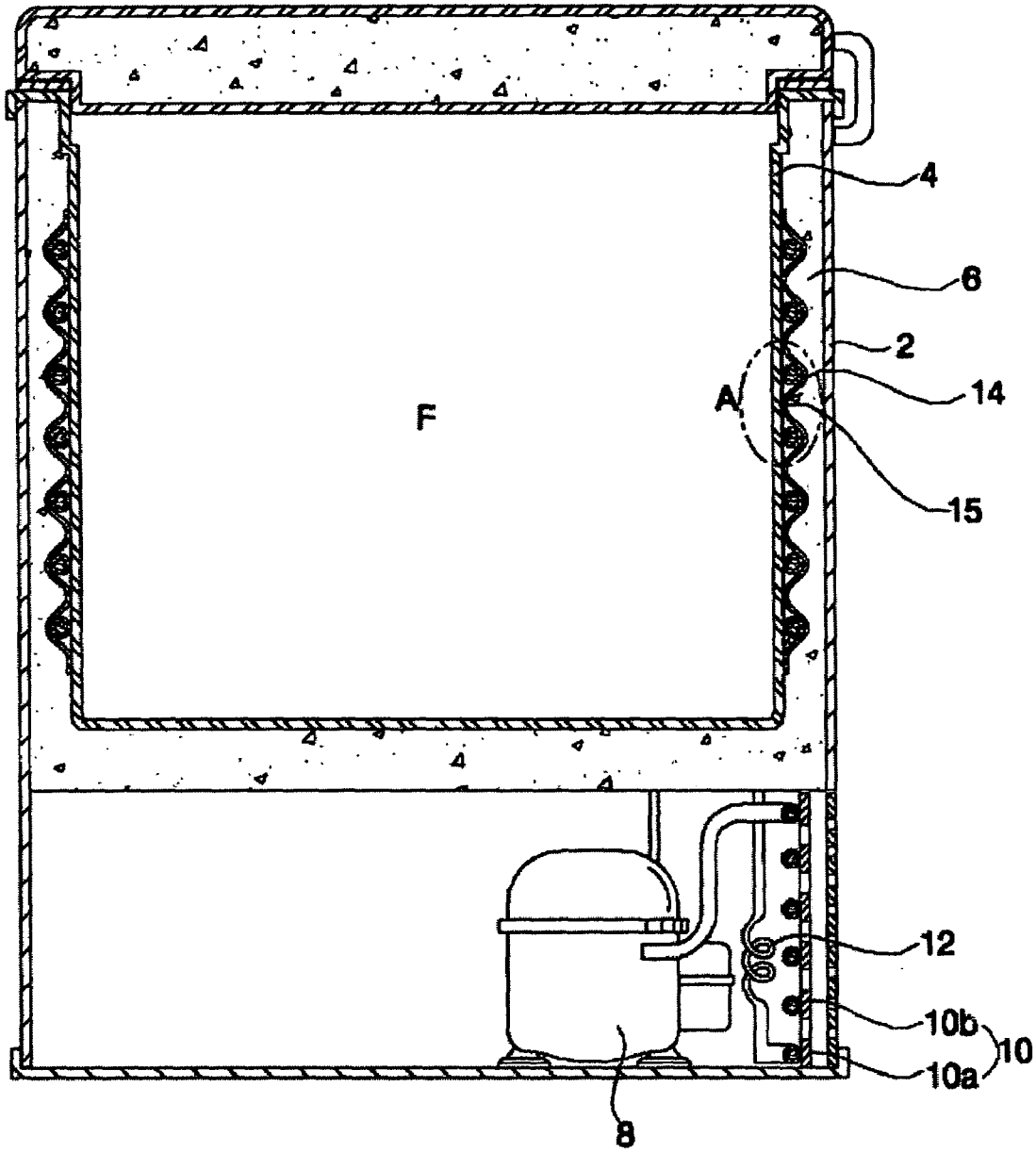
FIG. 1 (Prior Art)
FIG. 1 is a sectional view illustrating the inner structure of a general direct cooling type refrigerator.
Figure 2:
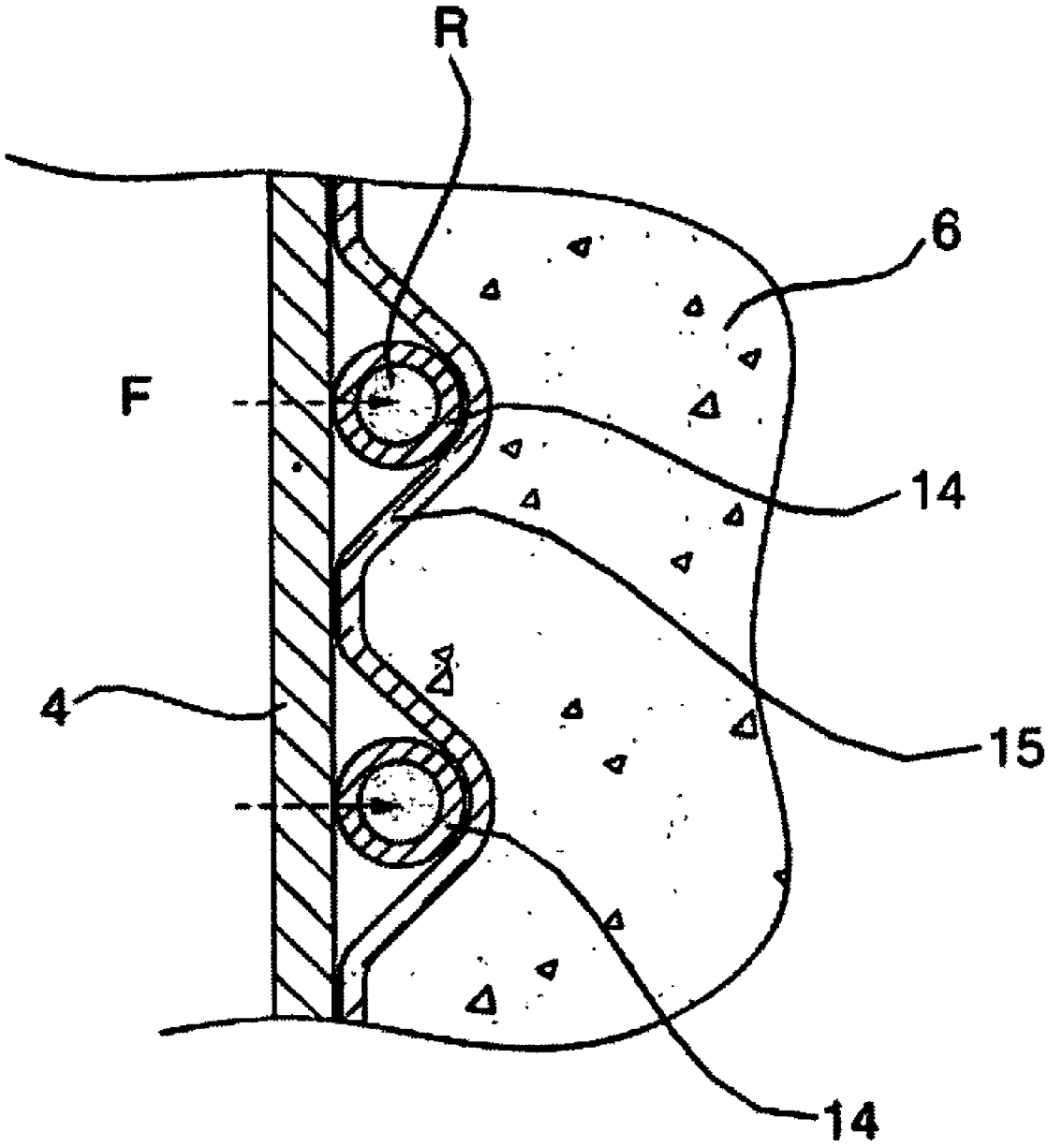
FIG. 2 (Prior Art)
FIG. 2 is an enlarged view corresponding to a portion "A" in FIG. 1, illustrating an example of an evaporator included in the genera direct cooling type refrigerator.
Figure 3:
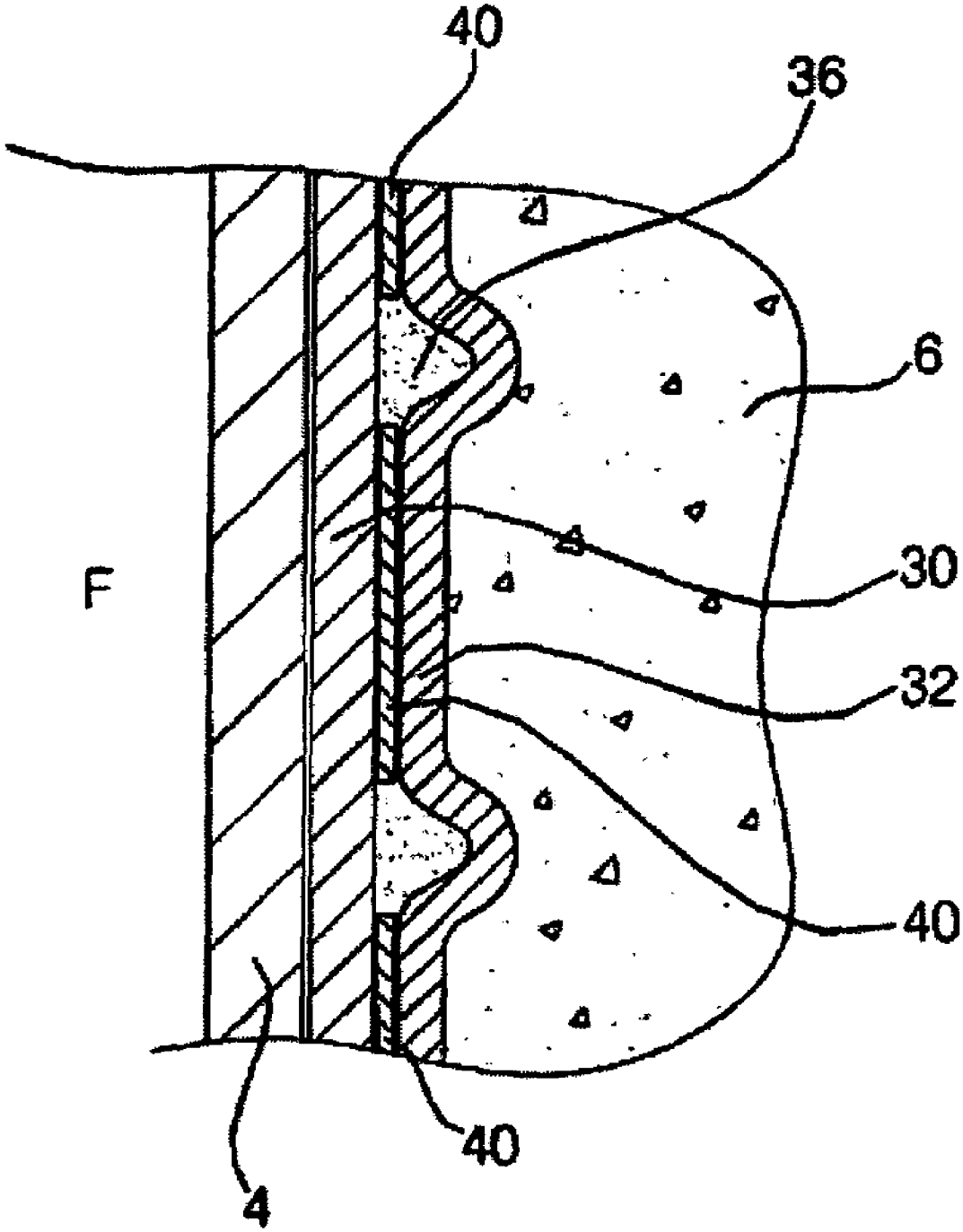
FIG. 3 (Prior Art)
FIG. 3 is a sectional view illustrating another example of an evaporator included in the general direct cooling type refrigerator.
Figure 4:
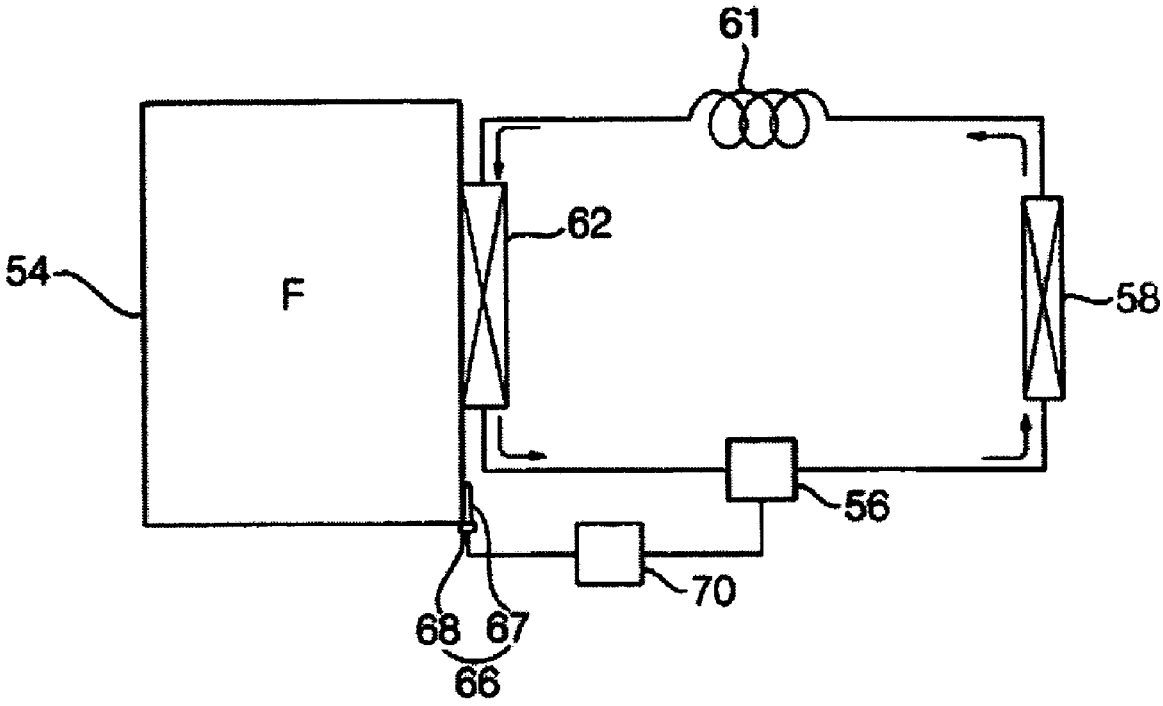
FIG. 4 is a block diagram illustrating the refrigerant circulation cycle in a direct cooling type refrigerator according to a first embodiment of the present invention.
Figure 5:
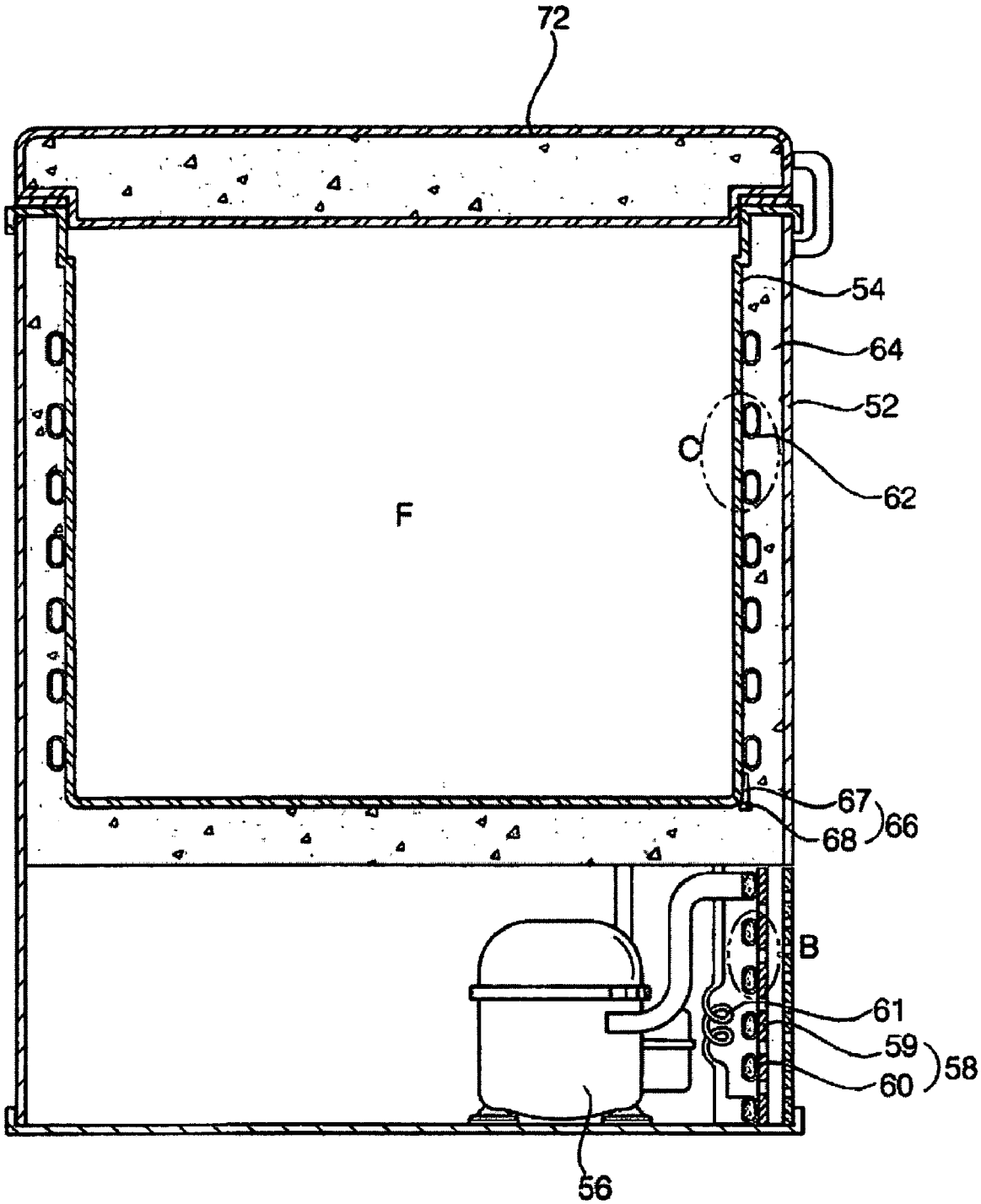
FIG. 5 is a sectional view illustrating an inner structure of the direct cooling type refrigerator according to the first embodiment of the present invention.

Referring to FIGS. 4 and 5, a direct cooling type refrigerator according to a first embodiment of the present invention is illustrated.

As shown in FIGS. 4 and 5, the direct cooling type refrigerator according to the illustrated embodiment of the present invention includes an outer casing 52 defining the appearance of the refrigerator, and an inner casing 54 arranged within the outer casing 52, and defined with a storage compartment F. This direct cooling type refrigerator also includes a compressor 56 for compressing a refrigerant, a condenser 58 for condensing a high-pressure refrigerant gas emerging from the compressor 56 into a liquid phase, a capillary tube 61 for reducing the pressure of the refrigerant emerging from the condenser 58, an evaporator 62 for performing heat exchange with the inner casing 54 in accordance with evaporation of the refrigerant passing therethrough, thereby cooling the inner casing 54, an insulator 64 interposed between the outer casing 52 and the inner casing 54, a temperature sensor 66 for sensing the temperature of the inner casing 54, and a control unit 70 for controlling the compressor 56 in accordance with the temperature sensed by the temperature sensor 66.

Figure 6:
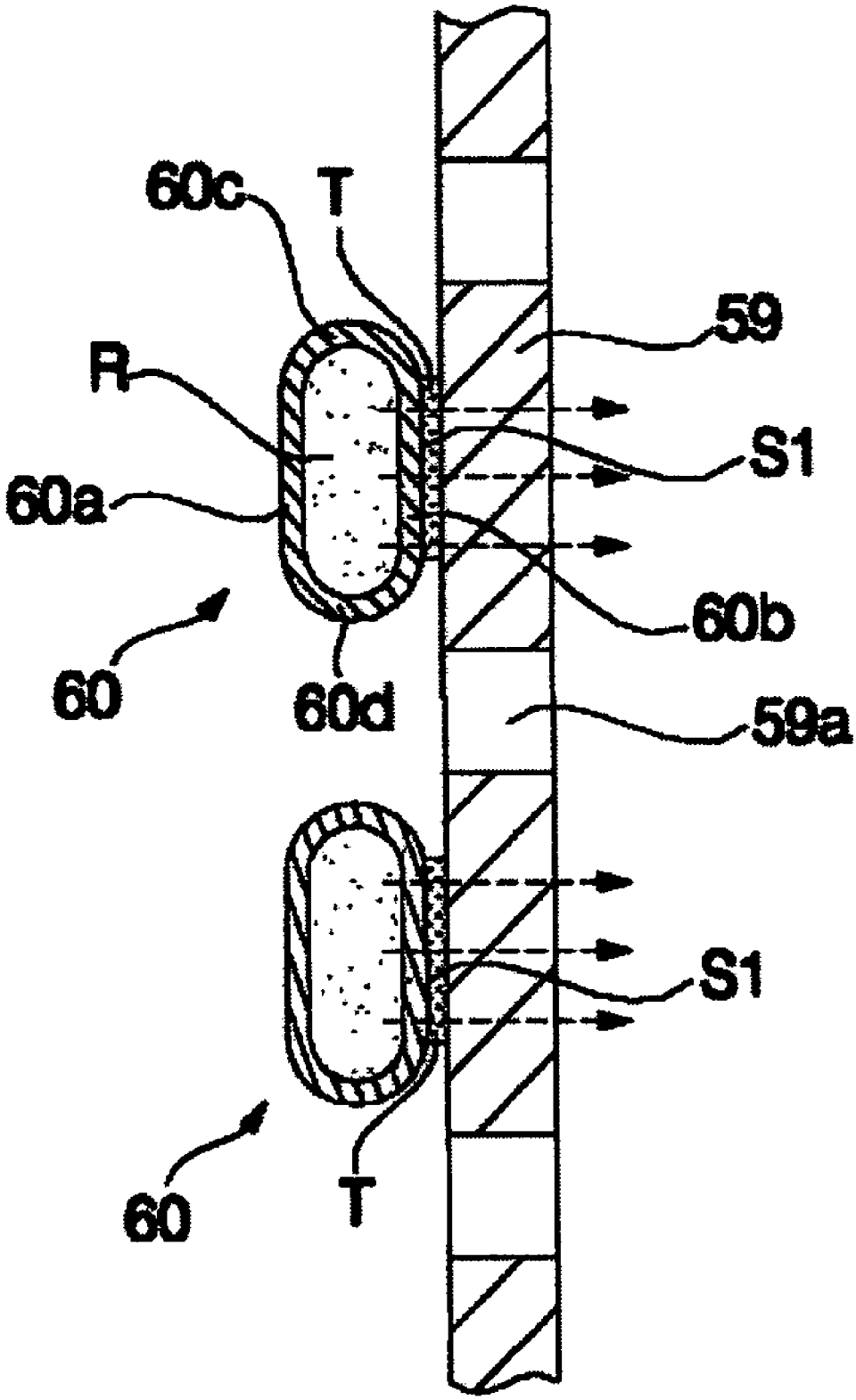
FIG. 6 is an enlarged view corresponding to a portion "B" in FIG. 5.

As shown in FIG. 6, the condenser 58 includes a heat transfer plate 59, and a condensing pipe 60 attached to one surface of the heat transfer plate 59, and adapted to allow a refrigerant R to pass therethrough. The condensing pipe 60 is provided with a surface contact area $S_1$ adapted to be in surface contact with the heat transfer plate 59.

The heat transfer plate 59 is formed with through holes 59*a* so that it can easily discharge heat therefrom into surrounding air.

The condensing pipe 60 has opposite flat side portions 60*a* and 60*b*, and curved upper and lower portions 60*c* and 60*d*. One of the opposite side portions 60*a* and 60*b*, that is, the side portion 60*b*, provides the surface contact area $S_1$ to be in surface contact with the heat transfer plate 59, so that heat from the refrigerant R is transferred to the heat transfer plate 59 via the surface contact area $S_1$, as indicated by arrows in FIG. 6.

The condensing pipe 60 is bent to have a zig-zag shape, and fixed to one surface of the heat transfer plate 59 by means of jigs or an adhesive T.

Figure 7:
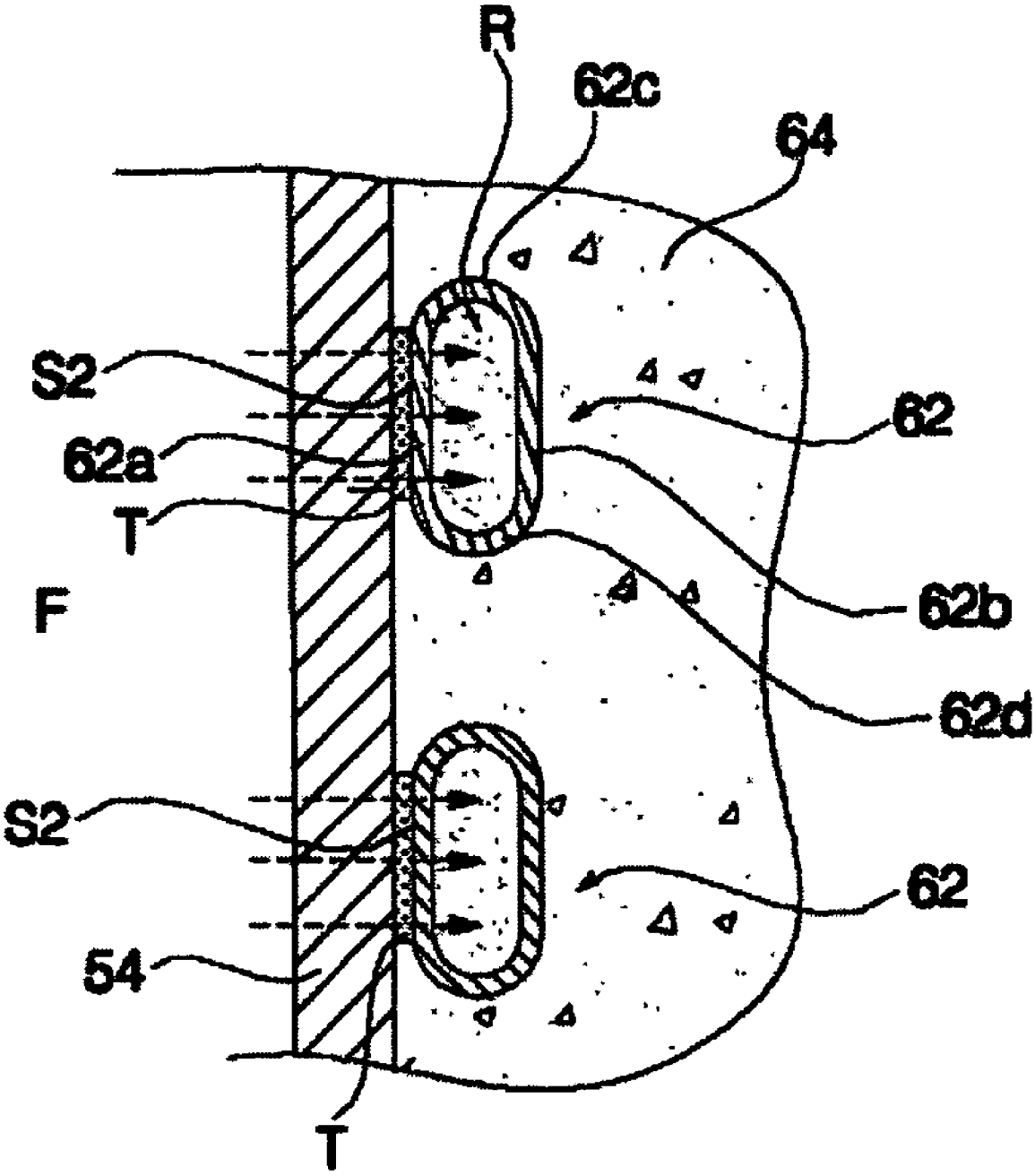
FIG. 7 is an enlarged view corresponding to a portion "C" in FIG. 5.

As shown in FIG. 7, the evaporator 62 is an evaporating pipe attached to the outer side surfaces of the inner casing 54, and adapted to allow the refrigerant R to pass therethrough. The evaporating pipe 62 is arranged along the outer surface of the inner casing 54. This evaporating pipe 62 has a plurality of connected pipe portions extending horizontally while being vertically spaced apart from one another. The evaporating pipe 62 is provided with a flat surface contact area $S_2$ adapted to be in surface contact with the inner casing 54, at a region where it is to be in contact with the inner casing 54.

The evaporating pipe 62 is directly attached to the outer side surfaces of the inner casing 54 by an adhesive T, while being covered by the insulator 64.

The surface contact area $S_2$ of the evaporating pipe 62 extends in a longitudinal direction of the evaporating pipe 62.

The condensing pipe 60 has opposite flat side portions 62*a* and 62*b*, and curved upper and lower portions 62*c* and 62*d*. One of the opposite side portions 62*a* and 62*b*, that is, the side portion 62*b*, provides the surface contact area $S_2$ to be in surface contact with the inner casing 54, so that heat from the inner casing 54 is transferred to the refrigerant R via the surface contact area $S_2$, as indicated by arrows in FIG. 7.

As shown in FIG. 4, the temperature sensor 66 includes a heat transfer member 67 made of a synthetic resin, and a thermistor 68 arranged to be in contact with a desired portion of the heat transfer member 67, and adapted to output a signal representing the temperature of the heat transfer member 67 to the control unit 70.

The control unit 70 serves to turn on the compressor 56 when the temperature sensed by the temperature sensor 66 is not less than a first predetermined temperature, for example, 5° C., while turning off the compressor 56 when the sensed temperature is not more than a second predetermined temperature, for example, −30° C.

In FIG. 5, the reference numeral "72" designates a door for opening and closing the storage compartment F.

Now, operation of the refrigerator having the above described configuration according to the present invention will be described.

Heat from the inner casing 54 is transferred to the temperature sensor 66 via a contact area where the temperature sensor 66 is in contact with the inner casing 54. The temperature sensor 66 measures the temperature of the heat transferred thereto, and sends a signal representing the measured temperature to the control unit 70.

When the control unit 70 determines, based on the signal received thereto, that the temperature of the inner casing 54 is not less than the first predetermined temperature, for example, 5° C., it outputs an ON signal so as to operate the compressor 56.

In an ON state thereof, the compressor 56 compresses the refrigerant R into a high-temperature and high-pressure vapor state. The compressed refrigerant R is then introduced into the condensing pipe 60 of the condenser 58. The refrigerant R discharges heat therefrom into the heat transfer plate 59 via the surface contact area S1 in surface contact with the heat transfer plate 59 while passing through the condensing pipe 60, as indicated by the arrows in FIG. 6, so that it is condensed into a normal-temperature and high-pressure liquid phase.

At this time, the heat from the refrigerant R is rapidly transferred to the heat transfer plate 59 because the contact area between the heat transfer plate 59 and the condensing pipe 60 is large.

Subsequently, the refrigerant R condensed by the condenser 58 is subjected to a pressure reduction process while passing through the capillary tube 61, and then absorbing heat from the inner casing 54 while passing through the evaporator 62, so that it is evaporated. The resultant refrigerant is then introduced into the compressor 58. In such a manner, the refrigerant circulates.

During the compression, condensation, expansion, and evaporation of the refrigerant R carried out in the above described manner, the inner casing 54 discharges heat therefrom into the refrigerant R passing through the evaporating pipe 58, so that it is cooled. Accordingly, the interior of the storage compartment F is cooled by virtue of heat exchange performed between air present in the storage compartment F and the inner casing 54, and natural convection of the air in the storage compartment F.

As the inner casing 54 and storage compartment F are cooled in the above described manner, the heat from the inner casing 54 is rapidly transferred to the evaporating pipe 62 via the surface contact area $S_2$ in surface contact with the inner casing 54, as indicated by the arrows in FIG. 7. The heat transferred to the evaporating pipe 62 is then rapidly transferred to the refrigerant R passing through the evaporating pipe 62.

As the inner casing 54 and storage compartment F are cooled in the above described manner, the heat from the inner casing 54 is also transferred to the temperature sensor 66 via the contact area where the temperature sensor 66 is in contact with the inner casing 54. The temperature sensor 66 measures the heat transferred thereto, and sends a signal representing the measured temperature to the control unit 70.

When the control unit 70 determines, based on the signal received thereto, that the temperature of the inner casing 54 is not more than the second predetermined temperature, for example, −30° C., it outputs an OFF signal to the compressor 58 so as to stop the operation of the compressor 58.

The interior of the storage compartment F is heated by heat penetrating into the storage compartment F through the insulator 64 and door 72 with the lapse of time, because the compressor 58 is maintained in its OFF state, and the low-temperature refrigerant is introduced into the compressor 56 no longer. Accordingly, the interior of the storage compartment F is not overcooled to a temperature not more than the second predetermined temperature, for example, −30° C.

Thereafter, the refrigerator repeats the turning on/off of the compressor 56 in accordance with the temperature sensed by the temperature sensor 66.

Figure 8:
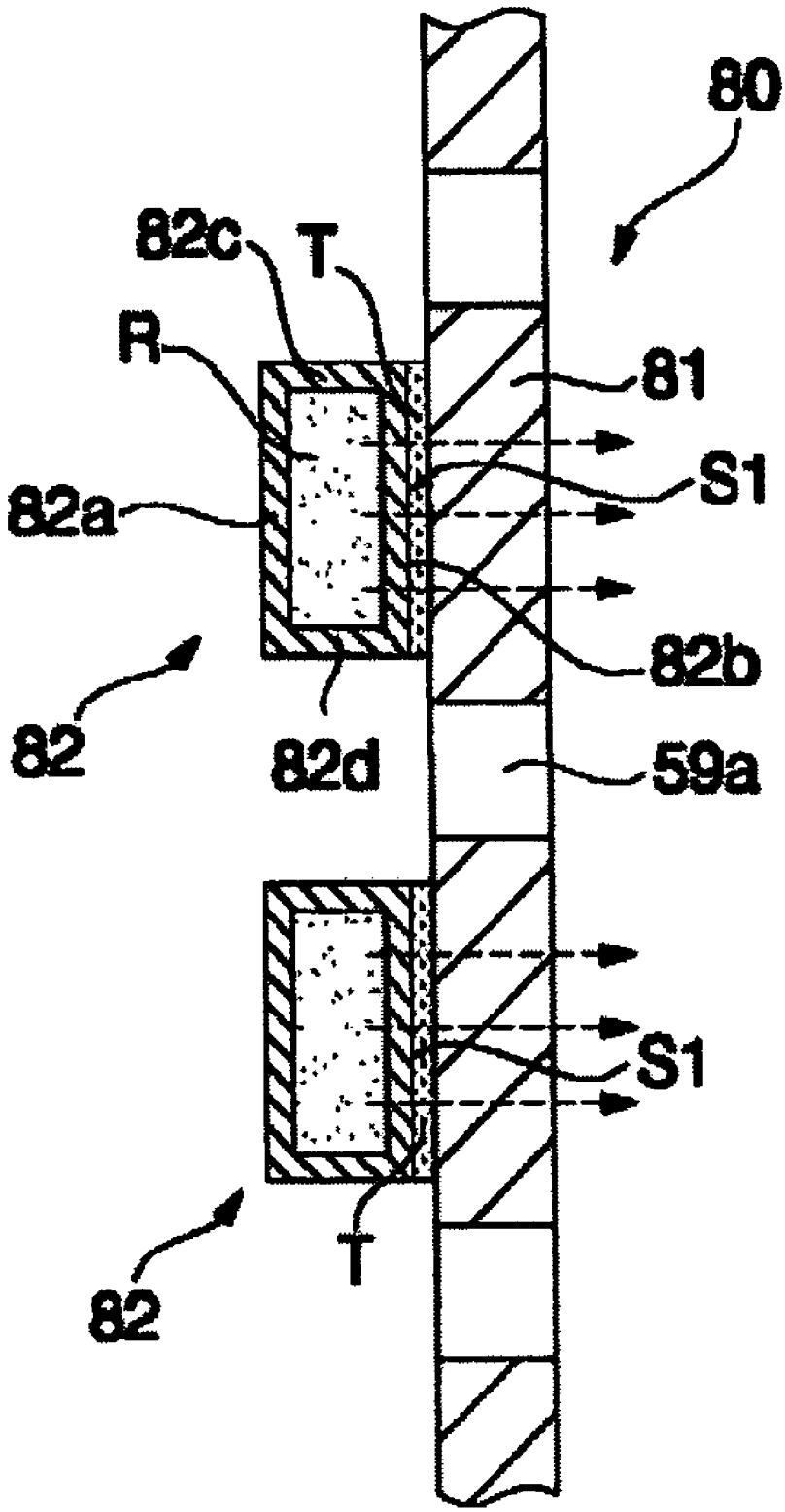
FIG. 8 is a sectional view illustrating an essential configuration of a direct cooling type refrigerator according to a second embodiment of the present invention.

Referring to FIG. 8, a condenser in a refrigerator according to a second embodiment of the present invention is illustrated.

The condenser 80 shown in FIG. 8 includes a heat transfer plate 81, and a condensing pipe 82 attached to one surface of the heat transfer plate 81, and adapted to allow the refrigerant R to pass therethrough. The condensing pipe 82 has a rectangular cross-sectional structure having four flat portions 82*a* to 82*d* so that it is in surface contact with the heat transfer plate 81 at one of its four flat portions 82*a* to 82*d*, that is, the flat portion 82*b*.

In this condenser 80, the flat portion 82*b* of the condensing pipe 82 provides a surface contact area $S_1$ adapted to be in surface contact with the heat transfer plate 81.

Figure 9:
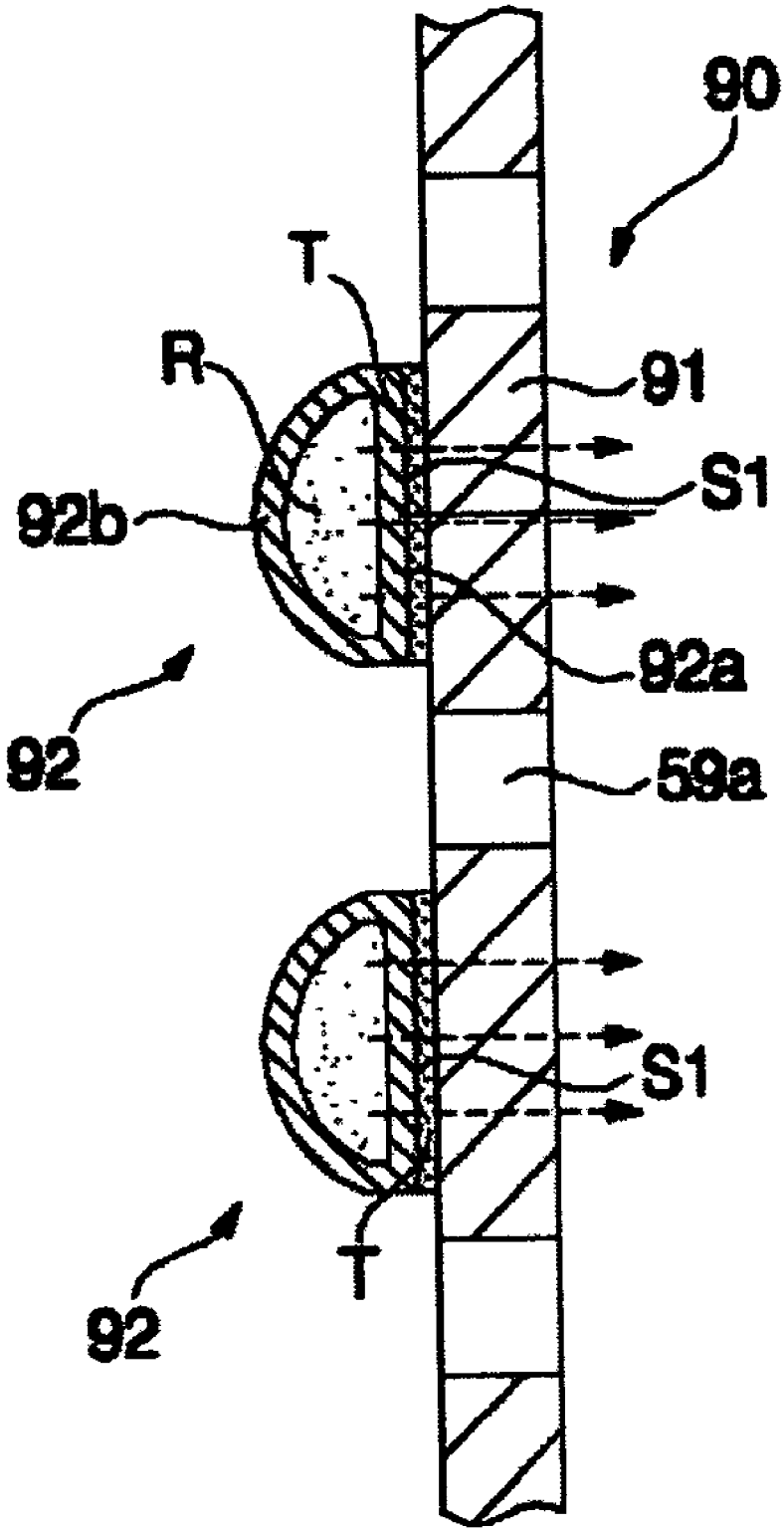
FIG. 9 is a sectional view illustrating an essential configuration of a direct cooling type refrigerator according to a third embodiment of the present invention.

Referring to FIG. 9, a condenser in a refrigerator according to a third embodiment of the present invention is illustrated.

The condenser 90 shown in FIG. 9 includes a heat transfer plate 91, and a condensing pipe 92 attached to one surface of the heat transfer plate 91, and adapted to allow the refrigerant R to pass therethrough. The condensing pipe 92 has a semicircular cross-sectional structure having a flat portion 92*a* and a curved portion 92*b* so that it is in surface contact with the heat transfer plate 91 at the flat portion 92*a*. The curved portion 92*b* is connected at upper and lower ends thereof to upper and lower ends of the flat portion 92*a*, respectively In this condenser 90, the flat portion 92*a* of the condensing pipe 92 provides a surface contact area $S_1$ adapted to be in surface contact with the heat transfer plate 91.

Figure 10:
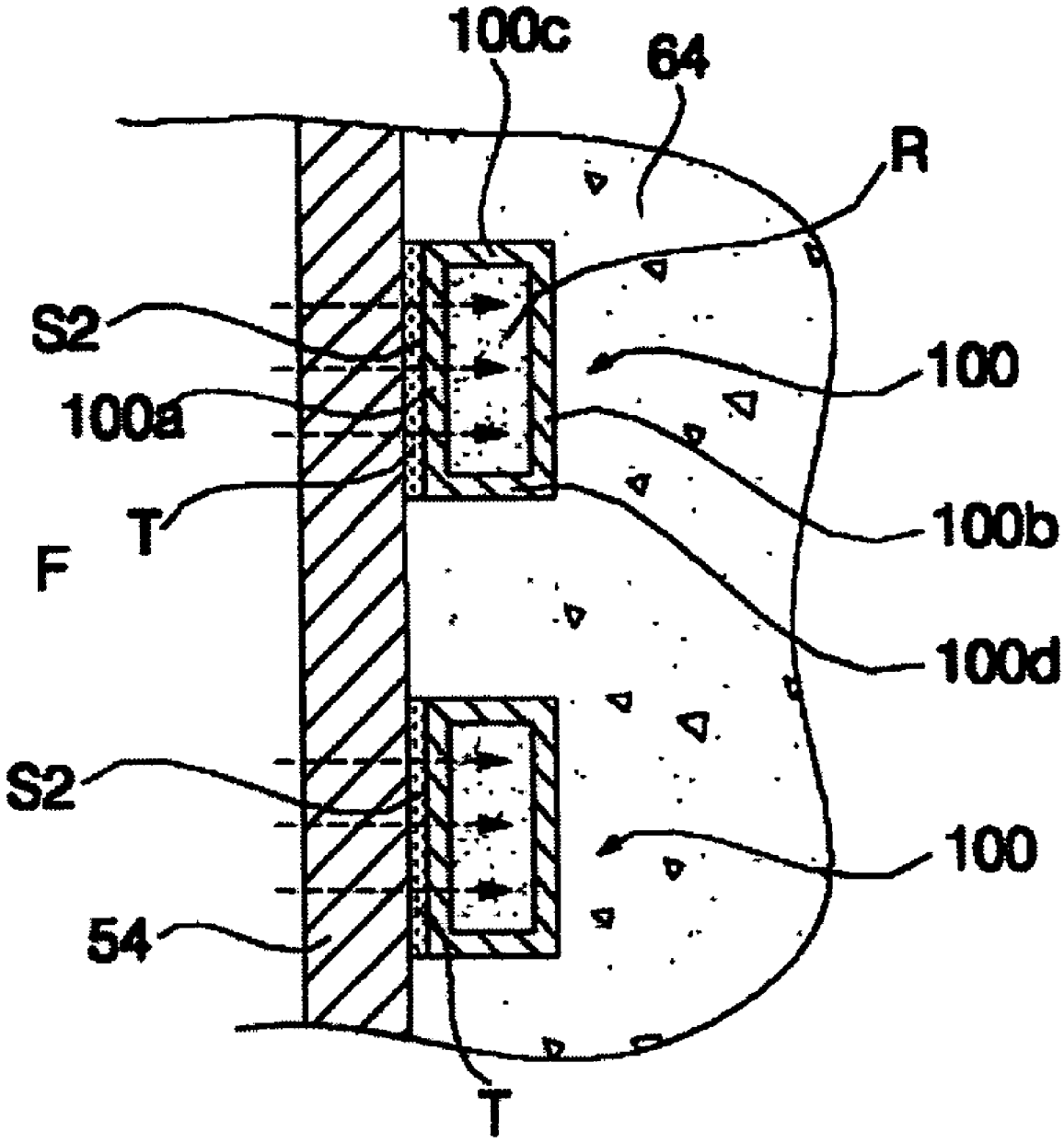
FIG. 10 is a sectional view illustrating an essential configuration of a direct cooling type refrigerator according to a fourth embodiment of the present invention.

Referring to FIG. 10, an evaporator in a refrigerator according to a fourth embodiment of the present invention is illustrated.

The evaporator shown in FIG. 10 includes an evaporating pipe 100 attached to the inner casing 54, and adapted to allow the refrigerant R to pass therethrough. The evaporating pipe 100 has a rectangular cross-sectional structure having four flat portions 100*a* to 100*d* so that it is in surface contact with the inner casing 54 at one of its four flat portions 100*a* to 100*d*, that is, the flat portion 100*a*.

In this evaporator, the flat portion 100*a* of the evaporating pipe 100 provides a surface contact area $S_2$ adapted to be in surface contact with the inner casing 54. The remaining three flat portions 100*b* to 100*d* are surrounded by the insulator 64.

Figure 11:
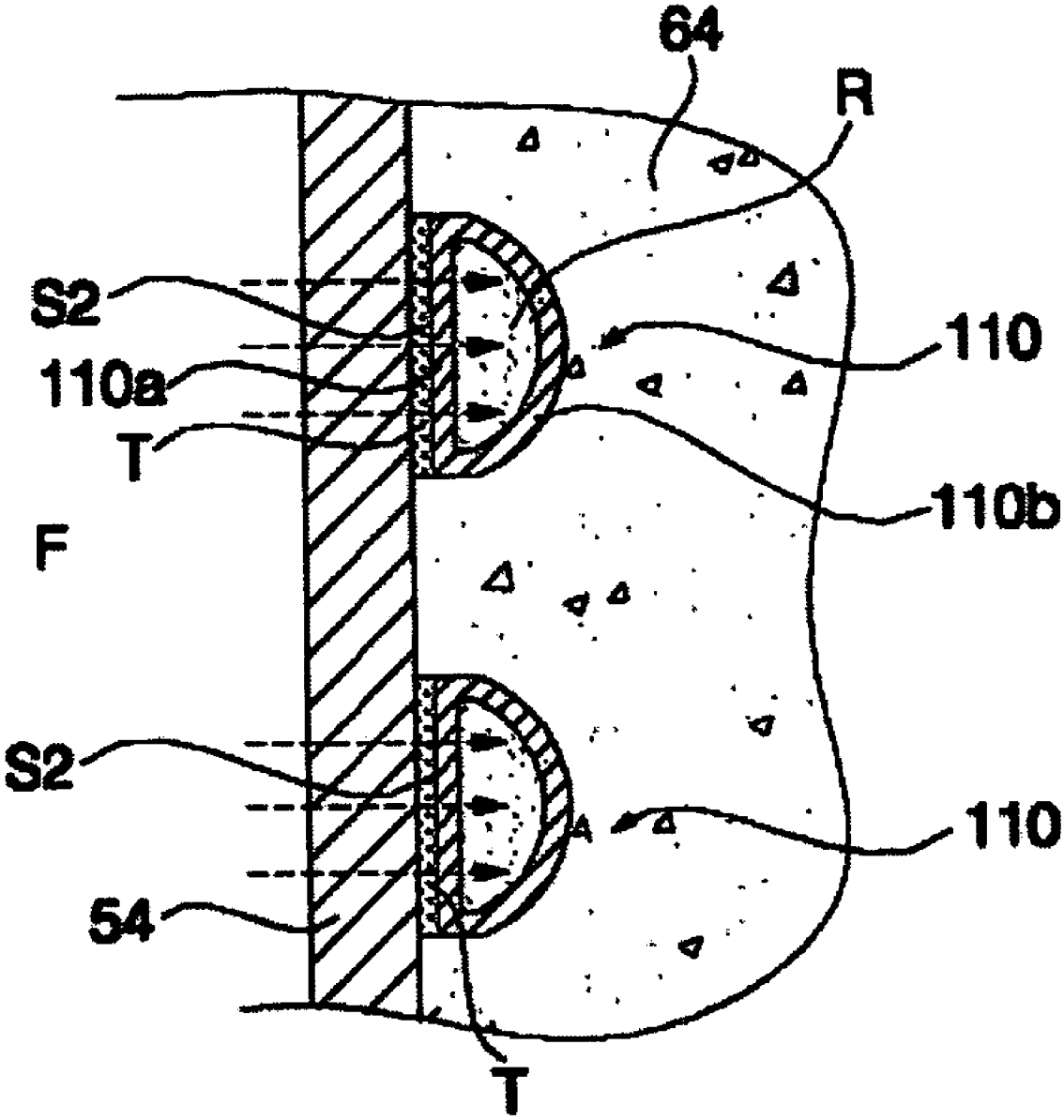
FIG. 11 is a sectional view illustrating an essential configuration of a direct cooling type refrigerator according to a fifth embodiment of the present invention.

Referring to FIG. 11, an evaporator in a refrigerator according to a fifth embodiment of the present invention is illustrated.

The evaporator shown in FIG. 10 includes an evaporating pipe 110 attached to the inner casing 54, and adapted to allow the refrigerant R to pass therethrough. The evaporating pipe 110 has a semicircular cross-sectional structure having a flat portion 110*a* and a curved portion 110*b* so that it is in surface contact with the inner casing 54 at the side portion 110*a*.

In this evaporator, the flat portion 110*a* of the evaporating pipe 110 provides a surface contact area $S_2$ adapted to be in surface contact with the inner casing 54. The curved portion 110*b* is surrounded by the insulator 64.

Figure 12:
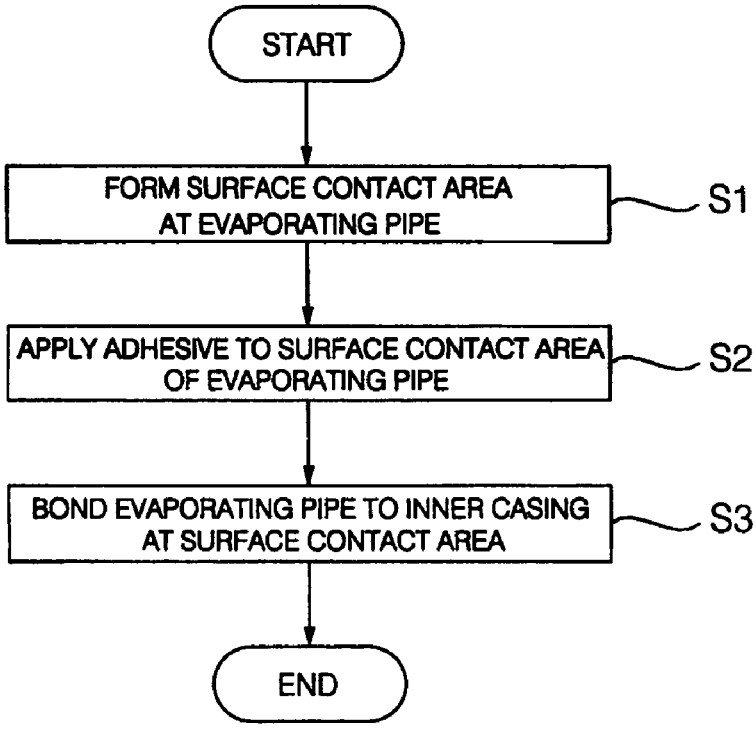
FIG. 12 is a flow chart illustrating a first embodiment of an evaporating pipe fixing method in the direct cooling type refrigerator according to the present invention.
Figure 13:
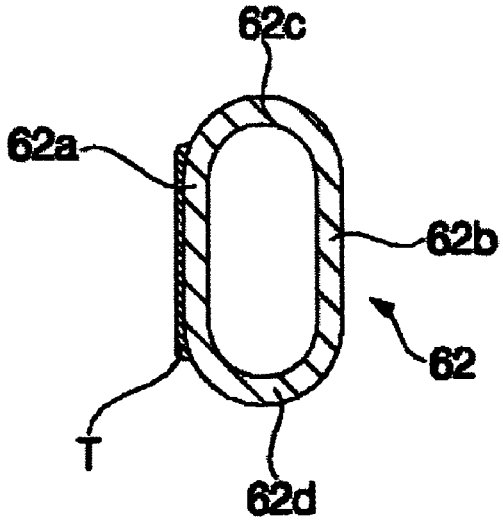
FIG. 13 is an enlarged sectional view illustrating an evaporating pipe of the direct cooling type refrigerator according to the present invention which is not in a fixed state yet.

FIG. 12 illustrates a first embodiment of an evaporating pipe fixing method in the direct cooling type refrigerator according to the present invention. FIG. 13 is an enlarged sectional view illustrating the evaporator of the direct cooling type refrigerator according to the present invention which is not in a fixed state yet.

In accordance with the evaporating pipe fixing method, a surface contact area adapted to come into contact with the inner casing 54 is first formed at one side portion of the evaporating pipe 62, that is, the side portion 62*a*, as shown in FIGS. 12 and 13 (S1).

The first step is carried out by preparing a hollow circular pipe for the evaporating pipe 62, and pressing the prepared hollow circular pipe in opposite lateral directions or in both opposite lateral directions and opposite vertical directions, thereby forming a flat portion for the surface contact area.

At a second step, an adhesive T is applied to the surface contact area of the evaporating pipe 62 (S2).

At a third step, the evaporating pipe 62 is extended along the outer side surfaces of the inner casing 54 such that it comes into close contact with the inner casing 54, thereby causing the surface contact area of the evaporating pipe 62 to be bonded to the inner casing 54, just after the application of the adhesive T at the second step (S3).

Thus, the evaporating pipe 62 is firmly fixed to the inner casing 54 in a state in which the surface contact area is in surface contact with the inner casing 54.

Figure 14:
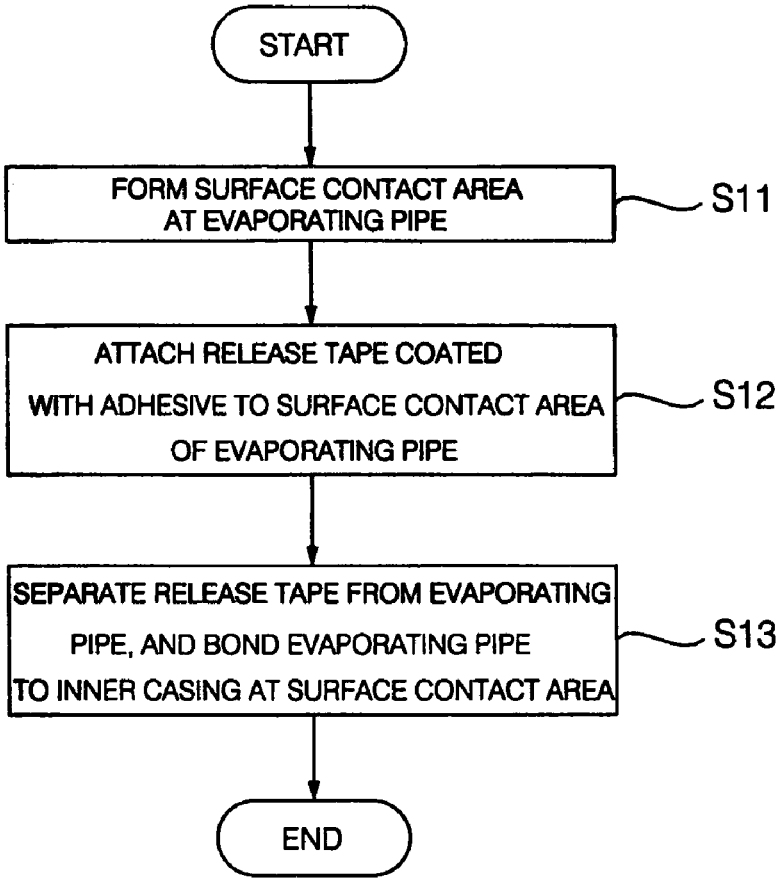
FIG. 14 is a flow chart illustrating a second embodiment of an evaporating pipe fixing method in the direct cooling type refrigerator according to the present invention.
Figure 15:
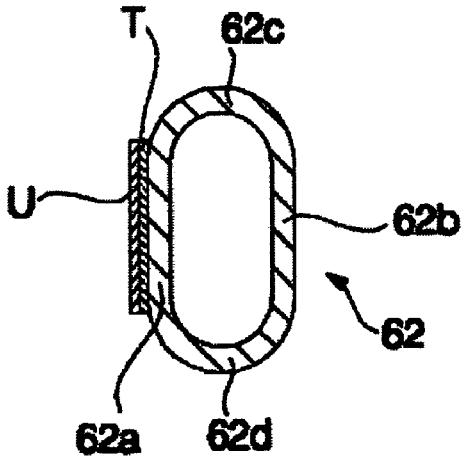
FIG. 15 is an enlarged sectional view illustrating an evaporating pipe of the direct cooling type refrigerator according to the present invention which is not in a fixed state yet.

FIG. 14 illustrates a second embodiment of an evaporating pipe fixing method in the direct cooling type refrigerator according to the present invention. FIG. 15 is an enlarged sectional view illustrating the evaporator of the direct cooling type refrigerator according to the present invention which is not in a fixed state yet.

In accordance with the evaporating pipe fixing method, a surface contact area adapted to come into contact with the inner casing 54 is first formed at one side portion of the evaporating pipe 62, that is, the side portion 62*a*, as shown in FIGS. 14 and 15 (S11).

The first step is carried out by preparing a hollow circular pipe for the evaporating pipe 62, and pressing the prepared hollow circular pipe in opposite lateral directions or in both opposite lateral directions and opposite vertical directions, thereby forming a flat portion for the surface contact area.

At a second step, a release tape U coated with an adhesive T is attached to the surface contact area 62*a* of the evaporating pipe 62 after the first step (S12).

Preferably, the release tape U is made of a paper sheet or a synthetic resin film so that its attachment and detachment can be easily achieved.

Thus, the evaporating pipe 62 can be stored or transported in a state of being attached with the adhesive T and release tape U.

At a third step, the release tape U is separated from the evaporating pipe 62 such that the adhesive T is exposed. Thereafter, the evaporating pipe 62 is extended along the outer side surfaces of the inner casing 54 such that it comes into close contact with the inner casing 54, thereby causing the surface contact area of the evaporating pipe 62 to be bonded to the inner casing 54 (S13).

Thus, the evaporating pipe 62 is firmly fixed to the inner casing 54 in a state in which the surface contact area is in surface contact with the inner casing 54.

As apparent from the above description, the refrigerator having the above described configuration according to the present invention has an advantage in that since the inner casing is in surface contact with the evaporator adapted to cool the inner casing, it is possible to rapidly discharge heat from the inner casing through the region where the inner casing is in surface contact with the evaporator, so that the refrigerant exhibits an increased heat exchange performance, thereby rapidly cooling the storage compartment.

Since the evaporator is in surface contact with the inner casing, it does not have any non-contact portion, so that it is possible to minimize temperature dispersion in the storage compartment.

Also, the condenser included in the direct cooling type refrigerator according to the present invention includes a heat transfer plate, and a condensing pipe provided with a surface contact area adapted to be in surface contact with the heat transfer plate. Accordingly, the refrigerant exhibits an increased heat exchange performance, thereby rapidly cooling the storage compartment.

One evaporating pipe fixing method in the above described direct cooling type refrigerator according to the present invention involves the steps of forming, at the evaporating pipe, a surface contact area adapted to come into contact with the inner casing, applying an adhesive to the surface contact area of the evaporating pipe, and bringing the evaporating pipe into close contact with the inner casing sensor such that it is bonded to the inner casing at the surface contact area. In accordance with this evaporating pipe fixing method, it is possible to minimize temperature dispersion in the storage compartment. Also, there is an advantage in that the evaporating pipe is firmly fixed to the inner casing.

Another evaporating pipe fixing method in the above described direct cooling type refrigerator according to the present invention involves the steps of forming, at the evaporating pipe, a surface contact area adapted to come into contact with the inner casing, and attaching a release tape coated with an adhesive to the surface contact area of the evaporating pipe. Since the adhesive is protected by the release tape, it is possible to easily and conveniently store or transport the evaporating pipe. When the evaporating pipe is to be fixed, the release tape is separated from the evaporating pipe such that the adhesive is exposed. In this state, the evaporating pipe is brought into close contact with the inner casing such that it is bonded to the inner casing at the surface contact area. In accordance with this evaporating pipe fixing method, it is possible to minimize temperature dispersion in the storage compartment. Also, there is an advantage in that the evaporating pipe is firmly fixed to the inner casing.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A direct cooling type refrigerator comprising:

an outer casing defining an appearance of the refrigerator;

an inner casing arranged within the outer casing, and defined with a storage compartment;

an insulator interposed between the outer casing and the inner casing;

a compressor for compressing a refrigerant; and an evaporator arranged to be in contact with the inner casing, and adapted to cool the inner casing in accordance with evaporation of a refrigerant passing therethrough, wherein the evaporator comprises an evaporating pipe having a no-circular cross-section, the evaporating pipe extending along outer side surfaces of the inner casing while being provided with a surface contact area at a portion thereof to be attached to the inner casing.

2. The direct cooling type refrigerator according to claim 1, wherein the evaporating pipe is arranged between the inner casing and the insulator.

3. The direct cooling type refrigerator according to claim 1, wherein the surface contact area extends in a longitudinal direction of the evaporating pipe.

4. The direct cooling type refrigerator according to claim 1, wherein the evaporating pipe has opposite flat side portions, and curved upper and lower portions.

5. The direct cooling type refrigerator according to claim 1, wherein the evaporating pipe has a rectangular cross-sectional structure.

6. The direct cooling type refrigerator according to claim 1, wherein the evaporating pipe has a flat portion, and a curved portion connected at upper and lower ends thereof to upper and lower ends of the flat portion, respectively.

7. The direct cooling type refrigerator according to claim 1, wherein the evaporating pipe has a plurality of connected pipe portions extending horizontally while being vertically spaced apart from one another.

8. A direct cooling type refrigerator comprising:

an outer casing defining an appearance of the refrigerator;

an inner casing arranged within the outer casing, and defined with a storage compartment;

an insulator interposed between the outer casing and the inner casing;

a compressor for compressing a refrigerant; and an evaporator arranged to be in contact with the inner casing, and adapted to cool the inner casing in accordance with evaporation of a refrigerant passing therethrough, wherein the evaporator comprises an evaporating pipe extending along outer side surface of the inner casing while being provided with a surface contact area at a portion thereof to be attached to the inner casing, and wherein the attachment of the evaporating pipe is achieved by an adhesive.

9. A direct cooling type refrigerator comprising:

an outer casing defining an appearance of the refrigerator;

an inner casing arranged within the outer casing, and defined with a storage compartment;

an insulator interposed between the outer casing, and the inner casing;

a compressor for compressing a refrigerant; and an evaporator arranged to be in contact with the inner casing, and adapted to cool the inner casing in accordance with evaporation of a refrigerant passing therethrough, wherein the refrigerator further comprises:

a condenser including a heat transfer plate, and a condensing pipe provided with a surface contact area adapted to be in surface contact with the heat transfer plate.

10. The direct cooling type refrigerator according to claim 9, wherein the condensing pipe has opposite flat side portions, and curved upper and lower portions.

11. The direct cooling type refrigerator according to claim 9, wherein the condensing pipe has a rectangular cross-sectional structure.

12. The direct cooling type refrigerator according to claim 9, wherein the condensing pipe has a flat portion, and a curved portion connected at upper and lower ends thereof to upper and lower ends of the flat portion, respectively.

13. A direct cooling type refrigerator comprising:

an outer casing defining an appearance of the refrigerator;

an inner casing arranged within the outer casing, and defined with a storage compartment;

an insulator interposed between the outer casing, and the inner casing;

a compressor for compressing a refrigerant; and an evaporator arranged to be in contact with the inner casing, and adapted to cool the inner casing in accordance with evaporation of a refrigerant passing therethrough, wherein the refrigerator further comprises:

a temperature sensor arranged to be in contact with the inner casing; and a control unit for controlling the compressor in accordance with a temperature sensed by the temperature sensor.

14. An evaporating pipe fixing method in a refrigerator comprising the steps of:

(A) forming, at an evaporating pipe, a surface contact area adapted to come into contact with an inner casing of the refrigerator;

(B) applying an adhesive to the surface contact area of the evaporating pipe; and (C) bringing the evaporating pipe into close contact with the inner casing such that it is bonded to the inner casing at the surface contact area.

15. The evaporating pipe fixing method according to claim 14, wherein the step (A) comprises the steps of:

preparing a hollow circular pipe for the evaporating pipe; and pressing the prepared hollow circular pipe in opposite lateral directions, thereby forming a flat portion for the surface contact area of the evaporating pipe.

16. The evaporating pipe fixing method according to claim 14, wherein the step (A) comprises the steps of:

preparing a hollow circular pipe for the evaporating pipe; and pressing the prepared hollow circular pipe in both opposite lateral directions and opposite vertical directions, thereby forming a flat portion for the surface contact area of the evaporating pipe.

17. An evaporating pipe fixing method in a refrigerator comprising the steps of:

(A) forming, at an evaporating pipe, a surface contact area adapted to come into contact with an inner casing of the refrigerator;

(B) attaching a release tape coated with an adhesive to the surface contact area of the evaporating pipe; and (C) separating the release tape from the evaporating pipe such that the adhesive is exposed, and bringing the evaporating pipe into close contact with the inner casing such that it is bonded to the inner casing at the surface contact area.

18. The evaporating pipe fixing method according to claim 17, wherein the step (A) comprises the steps of:

preparing a hollow circular pipe for the evaporating pipe; and pressing the prepared hollow circular pipe in opposite lateral directions, thereby forming a flat portion for the surface contact area of the evaporating pipe.

19. The evaporating pipe fixing method according to claim 17, wherein the step (A) comprises the steps of:

preparing a hollow circular pipe for the evaporating pipe; and pressing the prepared hollow circular pipe in both opposite lateral directions and opposite vertical directions, thereby forming a flat portion for the surface contact area of the evaporating pipe.

20. The direct cooling type refrigerator according to claim 1, wherein the evaporating pipe has at least one substantially flat side in contact with the inner casing.

21. The direct cooling type refrigerator according to claim 9, wherein the condensing pipe has at least one substantially flat side in contact with the heat plate transfer.

22. The direct cooling type refrigerator according to claim 9, wherein the condensing pipe has a non-circular cross section.

* * * * *